United States Patent [19]

Belsky

[11] 3,946,694

[45] Mar. 30, 1976

[54] AUTOMATIC EMERGENCY BILGE WATER PUMPOUT SYSTEM

[76] Inventor: Robert Belsky, 2124 E. 38th St., Brooklyn, N.Y. 11234

[22] Filed: June 24, 1974

[21] Appl. No.: 482,324

[52] U.S. Cl. ..... 114/183 R; 115/.5 HC

[51] Int. Cl.[2] ..... B63B 13/00

[58] Field of Search ..... 114/183 R, 183 A, 184, 114/185, 197, 198; 115/.5 R, .5 HC; 137/112, 398

[56] References Cited

UNITED STATES PATENTS

| | | | |
|---|---|---|---|
| 558,912 | 4/1896 | Power | 114/184 |
| 979,633 | 12/1910 | Aaron | 114/184 |
| 1,304,961 | 5/1919 | Good | 114/184 |
| 1,582,715 | 4/1926 | Wensley | 137/398 |
| 2,121,664 | 6/1938 | Huckins | 114/183 R |
| 2,350,598 | 6/1944 | Faville | 114/198 |
| 3,550,612 | 12/1970 | Maxon | 137/112 |

*Primary Examiner*—Trygve M. Blix
*Assistant Examiner*—Edward R. Kazenske
*Attorney, Agent, or Firm*—Jacob L. Kollin

[57] ABSTRACT

An automatic emergency bilge water pumpout system. The system comprises a through-hull water intake pipe for a boat engine's cooling water pump and a valve for closing the intake of water through the through-hull intake pipe. Another emergency pipe for aspirating water from the interior of a boat bilge communicates with a part in the valve. Float for automatically closing off the flow of water through the through-hull intake pipe and simultaneously opening the valve's part to the other emergency pipe, for pumping out the boat's bilge when water reaches a dangerous level are provided.

4 Claims, 4 Drawing Figures

FIG. 1
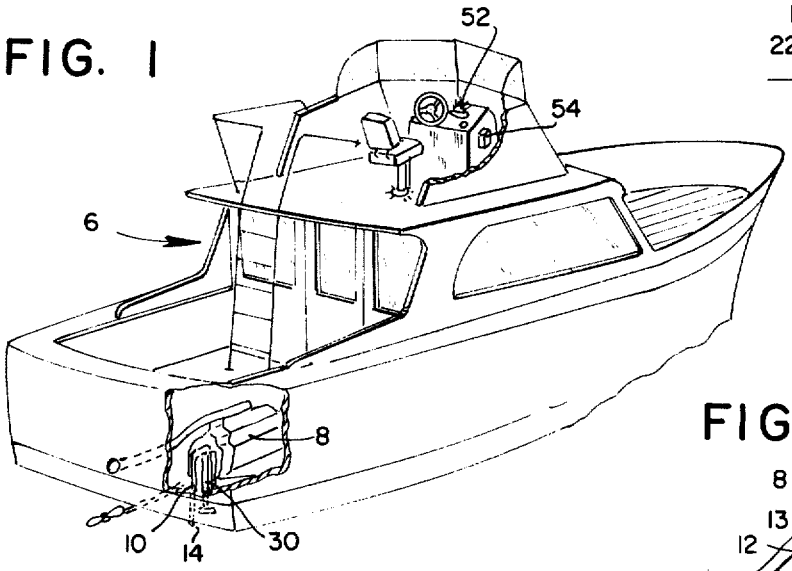
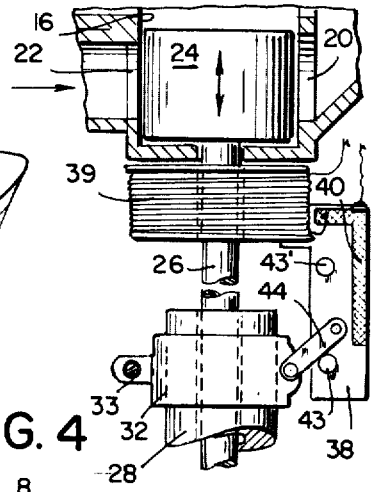
FIG. 4
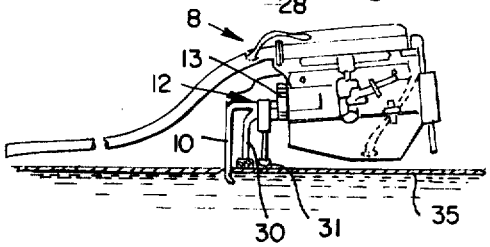
FIG. 2
FIG. 3
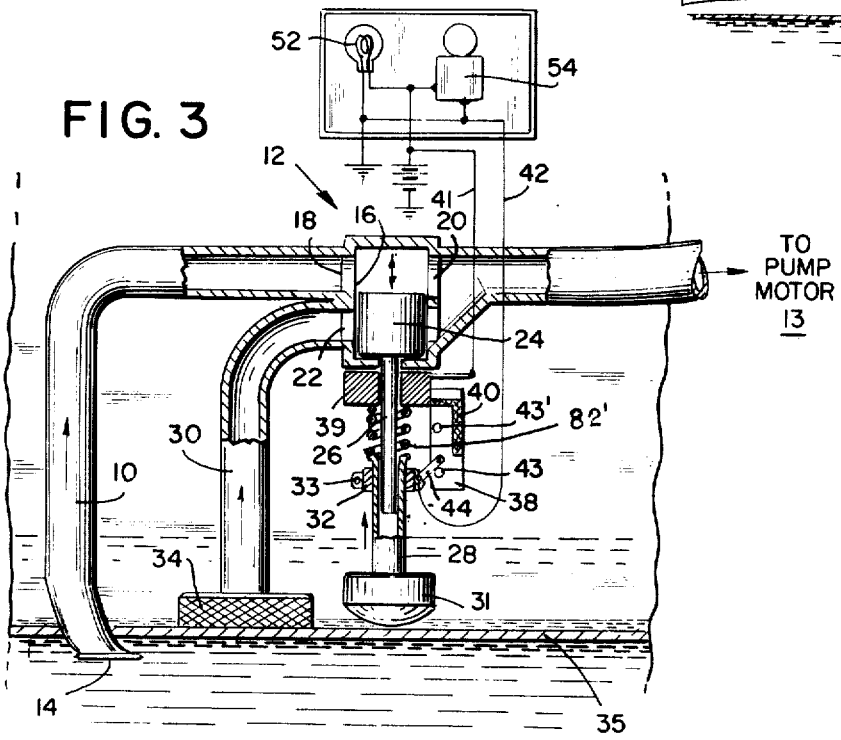

AUTOMATIC EMERGENCY BILGE WATER PUMPOUT SYSTEM

BACKGROUND OF THE INVENTION

This invention relates to marine pumpout systems in general and in particular to an automatic emergency bilge water pumpout system using the boat engine cooling system's water pump.

In the operation of a boat on sea, river or lake, a certain amount of water may accumulate in the boat's bilge. This water is usually pumped out by an electrically operated bilge pump. The bilge pump which is normally used to discard excess water accumulating in the bilge, cannot keep up with large demands. Besides the fact that it would be costly to install one which would be able to handle an emergency situation, it also uses a large amount of power which would run down the battery when used for any extended amount of time. In most cases the bilge pump is located in the bow of the boat, since it is usually the lowest level of the boat and therefore water tends to settle there. When an emergency arises, the very first thing which comes to mind is to make it back to shore. With a bilge pump this cannot be done very quickly. Upon acceleration the water flows to the rear of the boat and does not allow the bilge pump to operate. If one is in an emergency situation and cannot get back to shore quickly, the boat is in danger of sinking, since the bilge pump will not handle high demands. The amount of time it will take to get back will be too great. It will allow too much water to enter the boat and promote a serious condition. If speeded up, the pump will not operate. Thus one can either go fast and have the water rush to the back and sink the boat since the pump only pumps from the front, or go slow to allow the pump to work. The water will come in faster than the water going out and one is not going fast enough to get back before the boat is submerged. The operation of the pump might run the battery down and cause the motor to stall.

With the present invention the emergency system goes into operation. The motor either a V–8 or 6 cylinder uses far more water to cool it than the average heavy duty bilge pump. The motor which is cooled by its water pump will draw the water into the system and pass it overboard. This is a far superior system because one can maintain your course and keep afloat. The emergency pickup is located at the rear of the boat. Thus, when under way, the pickup would use the water surrounding it to cool the motor. Since the water pump depends on motor operation, the faster the motor goes the more water it pumps, so one may get home quickly and pump water in ratio of the motor speed. Even if a boat is equipped with two bilge pumps, only one is at the rear, so if an emergency arises only one is in operation and still can not handle an emergency. The inventive system uses no power to operate, does not affect the performance of the motor, nor does it affect the efficiency or economy of the motor to which it is connected. The changeover from the normal system to the safety system is prompt.

It is accordingly an object of the invention to provide a bilge water pumpout system using the boat engine's water pump to dispose of excess water which has reached a dangerous level in the bilge.

A further object of the invention is to provide a system of the above character which is automatic in operation.

A further object of the invention is to provide signaling means for alerting the boat's pilot to the dangerous condition of water in the boat's bilge.

Yet another object of the invention is to provide a system of the above kind, which is simple in construction, dependable in operation and can be manufactured at the reasonable cost.

These and other objects of the invention will become apparent from the following description in connection with the appended drawing illustrating a preferred embodiment of the invention. It is to be understood, however, that these are given by way of illustration and not of limitation and that changes may be made in the detail construction, form and size of the parts, without affecting the scope of the invention sought to be protected.

In the drawing:

FIG. 1 is a view of the boat showing the alarm instruments of the device and part of the boat engine;

FIG. 2 is a general view of the engine and the safety system employed therewith;

FIg. 3 shows the device, partly in section;

FIG. 4 is an enlarged detail of the switch mechanism.

Referring now to the drawing in detail, the boat 6 is provided with an internal combustion engine 8 having a through-hull water inlet pipe 10 leading to the engine's water pump 13 for cooling the engine. A valve 12 is built into the inlet pipe 10 intermediate the engine's pump and the open inlet end 14, of the pipe 10. The valve comprises a cylindrical housing 16 having passages 18, 20 and 22. Slidably mounted in the housing 16 is a piston 24 which is secured to one end portion of a rod 26, a sleeve 28 being adjustably secured to another end portion of the rod. Attached to the sleeve 28 is a float 31 which is adjustable along rod 26, by securing a movable clamp 32 to sleeve 28. The clamp connects the arm 44 to the sleeve. Pipe 30 communicates with one end with the opening 22 of the valve, which the other, free, end of pipe 30, is spaced from the inner face of the boat hull's bottom 35 and is provided with a filter 34, for filtering bilge water when it is drawn from the boat's bilge through pipe 30, as will be further described.

Secured to the lower part of housing 12 is a solenoid 39. Mounted at the bottom end of the solenoid is a non-conductive plate 38, provided with limit stops 43,43'. To plate 38 is secured a copper bracket 40. The bracket is connected to one terminal of the solenoid 39 while the other solenoid terminal is connected by wire 41 to the positive end of the boat's power source. A wire 42 secured to clamp 32 connects the clamp with the negative terminal of the boat's power source.

Pivoted on the clamp 32 is a contact arm 44. When the float 31 is in the position shown in solid lines in FIG. 3, the arm 44 rests on non-conductive stop 43 and does not contact the copper bracket 40 and current does not flow through solenoid 39. Should the float 31 be lifted by water rising in the bilge to a predetermined danger level, the contact arm 44 will arrive into position (not shown) and contact copper bracket 40, thus closing the solenoid circuit and energizing the solenoid 39. The cylinder 24 will move upward, closing the passages 18, 20, while simultaneously opening the passage 22. The light 52 and audio alarm 54 will alert the pilot to the dangerous water level in the bilge. At the same time water in the bilge will be rapidly pumped out of the bilge and overboard, by the boat engine's pump 13 through intake pipe 30. The cylinder 24 will continue to close the passages 18 and 20 until the water in the bilge reaches a safe level. While the bilge water is being pumped out, arm 44 will remain in contact with bracket 40, the solenoid holding the rod portion 26 and thus valve cylinder 24 in the upper, dotted line, position. The damaged boat will thus be able to reach the shore for assistance or to be beached until repairs can be made.

I claim:

1. In a boat hull, an emergency pumping system comprising, in combination with the boat engine's water pump, a through-hull water intake pipe having an open end submerged in water below the boat's hull and another end connected with said water pump, valve means disposed intermediate said through-hull pipe's ends, said valve means having a first inlet port for said through-hull intake pipe, an outlet port communicating with said pump, a second inlet port, an emergency water intake pipe having a free end positioned inwardly of said hull and another end connected with said second port, a float for operating said valve for closing said first port, while opening said second port, said float being operable when water reaches a dangerous level in the boat.

2. The combination as claimed in claim 1, wherein said valve means comprises a cylindrical housing, a piston displaceable in said housing for opening and closing said ports, a piston rod secured to said piston with its upper end to said piston, said float having a sleeve slidably adjustable on the piston rod's lower end, a clamp having a set screw for securing said sleeve on said piston rod.

3. The combination as claimed in claim 2, further comprising a solenoid mounted below said housing, said piston rod being displaceable in said solenoid, switch means for energizing said solenoid, operable by said float, said switch means being in a series circuit with a power source and the solenoid.

4. The combination as claimed in claim 3, wherein said switch means comprises an insulated member attached below said solenoid, a copper contact plate secured to said insulated member, said copper contact plate being electrically connected to one terminal of said power source, a contact arm pivoted to said clamp, said contact arm being adapted to engage with said copper contact plate upon upward movement of said float and said clamp being electrically connected to another terminal of said power source.

* * * * *